United States Patent [19]

Gorchakov et al.

[11] 4,021,154

[45] May 3, 1977

[54] SERVOMECHANISM FOR PUMP CAPACITY CONTROL

[76] Inventors: Mikhail Fedorovich Gorchakov, Trubnikovsky pereulok, 17, kv. 1, Moscow; Mikhail Grigorievich Kabakov, Petrovsko-Razumovsky proezd, 9, kv. 1, Moscow; Leonid Nikolaevich Kashtanov, 1 Dubrovskaya ulitsa 5, kv. 46, Moscow; Viktor Prokofievich Morozov, Fevralskaya ulitsa, 14/7, kv. 44, Klimovsk Moskovskoi oblasti; Jury Ivanovich Chuprakov, Volokolamskoe shosse, 3, kv. 54, Moscow; Vitaly Fedorovich Scherbakov, ulitsa Shabolovka, 35, kv. 10, Moscow, all of U.S.S.R.

[22] Filed: Oct. 2, 1975

[21] Appl. No.: 619,033

[52] U.S. Cl. ..... 417/218; 60/444; 60/447

[51] Int. Cl.[2] ..... F04B 49/00; F16D 31/02

[58] Field of Search ..... 60/444, 447; 417/218–222; 91/506

[56] References Cited

UNITED STATES PATENTS

| | | | |
|---|---|---|---|
| 3,065,735 | 11/1962 | Chaves et al. | 91/387 |
| 3,270,508 | 9/1966 | Smith et al. | 60/429 |
| 3,416,452 | 12/1968 | Misulis | 417/222 |

*Primary Examiner*—Carlton R. Croyle

*Assistant Examiner*—G. P. LaPointe

[57] ABSTRACT

A servomechanism for pump capacity control includes an adjustable throttle of the "nozzle-gate" type formed with two operating slots communicating through two fixed throttles with duct, a source of supply feeding the duct, an input signal converter whose movable element is connected to the gate of the nozzle-gate throttle and a four-slot, five-line distributor whose control spaces are in communication through two fixed throttles with the duct of the source of supply, two operating slots being formed in the adjustable throttle, whereas its operating spaces communicate with the corresponding spaces of an actuating hydraulic cylinder. The latter is connected to the control element and, by a mechanical position feedback, to the gate. The mechanical position feedback is constituted by a bar which is linked to the movable element of the hydraulic cylinder and has a slanted surface. The slanted surface interacts with a spring-loaded pusher, whose springs act on the gate. The servomechanism incorporates a device which ensures linear dependence of the speed of hydraulic cylinder movement on the displacement of the gate away from the neutral position, and acts on the slide valve of the four-slot five-line distributor. The servomechanism additionally includes a mechanism for limiting the power of the controlled pump, the mechanism being linked mechanically with the hydraulic cylinder and the gate of the nozzle-gate throttle, and hydraulically with the discharge line of the controlled pump.

9 Claims, 2 Drawing Figures

SERVOMECHANISM FOR PUMP CAPACITY CONTROL

The present invention relates in general to the field of hydrostatic transmissions, for example in construction and road-building machines, and more particularly to servomechanisms for pump capacity control.

The invention can be advantageously made use of for changing the inclination angle of a cylinder block, or of a slanted disc in axial-piston pumps, and for changing the eccentricity between the rotor and the stator of radial-piston or vane pumps.

At present the demand for raising the output of construction and road-building machines, and for automatic of their control call for the use of adjustable hydraulic drives, the controlled-capacity pump being one of the basic elements. The requirements of a remote pump control with minimum forces applied to the controlling element in the operator's cab are satisfied most efficiently by the use of servomechanisms with two-stage hydraulic amplifiers.

Known in the art are several types of servomechanisms with two-stage hydraulic amplifiers used for controlling the capacity of pumps.

In the two most commonly used servomechanisms a first amplification stage of the input signal is constituted by adjustable throttles of either the slide-valve type, or of the "nozzle-gate" construction, whereas a second stage has the form of a slide-valve distributor.

The servomechanism controlling the capacity of an axial-piston pump manufactured by Hydromatik (see publication 324EE412, Aug. 7, 1968 with Supplement D1439(1KH412) belongs to the first type.

The servomechanism includes a source of supply feeding a duct, the latter communicating through two fixed throttles with the adjustable throttle of the slide-valve type formed with two operating slots, a four-slot, 12-line distributor whose control spaces communicate through two fixed throttles with a duct feeding a source of supply and with two operating slots, of the adjustable throttle and a power-limiting device communicating with two additional control spaces of the distributor, whose operating spaces are in communication through operating lines with a hydraulic cylinder actuating the control element of the pump. The two additional control chambers communicate with a duct of the source of supply through two additional fixed throttles. The distributor slide-valve is connected to the movable casing of the hydraulic cylinder via a spring ensuring the position the hydraulic cylinder. Thus the cylinder position feedback is connected to the second amplification stage and does not therefore apply to the entire circuit of the servomechanism. The servomechanism additionally includes springs of a zero setter, the springs being connected to the distributor slide valve for setting the latter to a neutral position.

For controlling the pump capacity, the operator moves the adjustable throttle of the slide-valve type manually. This brings about a change in the resistance of the operating slots of the adjustable throttle, which in turn results in a change of pressure in the distributor control spaces which receive the operating fluid from the source of supply through fixed throttles. Being acted upon by the pressure difference in the control spaces, the distributor slide-valve moves in such a manner that one operating space of the distributor then communicates with the duct of the source of supply through the operating line and with one of the hydraulic cylinder spaces whereas the other operating space of the distributor is made to communicate with the return line and, through another operating line, with the other space of the hydraulic cylinder. The difference of pressures in the hydraulic cylinder spaces displaces the movable casing of the hydraulic cylinder and compresses the spring of the cylinder position feedback. The hydraulic cylinder casing keeps moving until the force of the compressed spring counterbalances the force of the pressure difference in the distributor control spaces, and the slide valve returns to the neutral position.

When the pressure in the discharge line of the controlled-capacity pump rises above the limit permissible for the given output, the power-limiting device acts upon the pressure in the additional control spaces of the distributor, so that a force is originated on the slide valve whose vector coincides with the direction of the force produced by the spring of the cylinder position feedback. This shifts the slide valve away from the neutral position and reduces the capacity of the controlled-capacity pump. Thus, the distributor slide valve is acted upon by the forces of the fluid pressure in the control spaces, the additional control spaces of the spring of the hydraulic cylinder position feedback, and of the zero setter spring.

The servomechanism ensures automatic control of pump capacity by a law approximating the constant power consumption law. The hyperbola of constant power is approximated by two straight sections which correspond to the characteristics of two springs of the power-limiting device.

Such a servomechanism is considerably large, due to, for example, a large distributor and a large feedback spring which interacts with the distributor slide valve of the second amplification stage and must, therefore, compensate for considerably great forces originated by the pressure difference in the distributor control spaces; this servomechanism is difficult to set for the zero capacity of the pump and fails to satisfy completely the requirements of remote control, since the adjustable slide-valve throttle is operated manually.

Inasmuch as the mechanical position feedback of the hydraulic cylinder is connected to the second amplification stage, the nonlinearities of the static characteristics of the adjustable throttle of the first stage, and those of the second stage distributor are summed. This calls for a higher manufacturing position of the adjustable throttle, and the distributor. All other conditions being equal, the operating speed of such a servomechanism is lower than that of the mechanism with the hydraulic cylinder position feedback connected to the first amplification stage.

The servomechanism produced by Hydromatik (Federal Republic of Germany), Katalog-Rigister 2-8.1, Ausgabe 8/72 which is basically of the same design as that described above, incorporates an electromagnetic control of the adjustable slide-valve throttle to the servomechanism dealt with above, which improves the remote control capacity of the servomechanism, since the control signal is fed in electrically.

A disadvantage of this type of control is due to the throttles of the slide-valve type requiring a considerably powerful input signal and not having sufficiently reliable and stable characteristics, i.e., dependence of the flow rate through the throttle on the value of the input signal in the control system and incorporation of electromechanical converters. With a further increase in the power of the electromechanical converter the characteristics of the control become sufficiently reliable and stable which, however, is accompanied by a considerable decrease in the operating speed of the servomechanism.

These disadvantages are eliminated in the servomechanism incorporating an adjustable throttle of the nozzle-gate type in the first stage.

Known in the art is a servomechanism produced by Moog in accordance with the U.S. Pat. No. 3,065,735, C1.121-41, Nov. 27, 1962, USA.

This servomechanism includes a duct for a source of supply communicating through two fixed throttles with an adjustable throttle of the nozzle-gate type having two operating slots between the nozzles and the gate and four-slot five-line distributor whose control spaces communicate through two fixed throttles with the duct of the source of supply, and with two operating slots of the adjustable nozzle-gate throttle.

The control spaces accommodate springs for alignment of the distributor slide valve. The gate of the adjustable nozzle-gate throttle is connected to the core of the electromechanical input signal converter, and is displaced together with the core back and forth due to the effect of the input signal changing the effective cross-sectional of the operating area slots.

The servomechanism controls an actuating hydraulic cylinder whose piston has a double-ended rod, one end of which is connected with the mechanism controlling the pump capacity, and the other end thereof is connected to is formed with the bar which a slanted surface.

The servomechanism also includes a mechanical position feedback of the actuating hydraulic cylinder. The feedback actuates the bar whose slanted surface interacts with a spring-loaded pusher. The pusher springs actuate the gate. Two operating spaces of the distributor communicate through the operating lines with the hydraulic cylinder spaces, the third operating space communicates with the duct of the source of supply, while the fourth and fifth spaces communicate with the return line. The operating spaces of the distributor communicate with each other through the distributor operating slots.

For adjusting the pump capacity, the operator changes the voltage in the winding of the electromechanical converter; this displaces the converter core together with the gate, changes the resistance of the operating slots in the adjustable nozzle-gate throttle, and the pressure in the control spaces of the distributor slide-valve.

The distributor slide-valve moves under the effect of the pressure difference in the control spaces.

The operating space of the distributor connected to the duct of the source of supply is in communication through the operating slot while its operating space communicates with the hydraulic cylinder space, the other operating space of the distributor communicating with the other space of the hydraulic cylinder and being connected through the other operating slot to one of its operating spaces connected to the return line. The difference of pressures in the hydraulic cylinder spaces moves the piston with the rod, and the bar formed with the slanted surface, until the force of the pusher springs counterbalances the forces on the core of the electromechanical converter. The gate then returns to the center position. The pressure in the distributor control spaces becomes equalized, the springs received in the control spaces shift the distributor slide valve to the initial position and the operating fluid will no longer be fed into the operating space of the hydraulic cylinder.

The known servomechanism can be controlled from a practically unlimitted distance and calls for a low-power input signal. The position feedback of the actuating hydraulic cylinder is additionally connected to the first amplification stage, i.e., it embraces the entire circuit of the servomechanism, which increases its operating speed somewhat, and reduces the requirements for the manufacturing accuracy of the servomechanism elements.

However, the provision of springs in the control spaces of the distributor calls for high manufacturing precision of the distributor to ensure linear changes in its cross-sectional area proportional to both the pressure difference in the control spaces, and to the force of springs disposed in these spaces. The forces with which the fluid jets act on the gate, due to the pressure difference in the control chambers of the distributor, depend on the stiffness of the springs, which in turn reduces the operating speed of the servomechanism.

The operating speed of the actuating hydraulic cylinder depends in the known servomechanism on the load, since an increase of the load applied to the actuating hydraulic cylinder raises pressure in its operating space and reduces the pressure difference in the distributor operating slot, whose cross-sectional area is strictly proportional to the pressure in the control spaces and to compression of the springs in those spaces, the pressure and compression being in turn proportional to the displacement of the gate, i.e., to the input signal.

It is an object of the present invention to provide automatic control of, for example, an excavator, according to the constant power law.

It is another object of the present invention to increase the operating speed of the servomechanism, and to eliminate the dependence of the speed of the actuating hydraulic cylinder on the load by introducing hydraulic feedback by means of the speed of movement of the actuating hydraulic cylinder.

It is a further object of the present invention to simplify the manufacturing technology, by reducing the requirements for the accuracy of dimensions of the distributor parts by deletion of the springs located in the control spaces of the distributor.

It is finally an object of the present invention to protect the controlled-capacity pump against a sharp pressure rise by introducing hydraulic feedback resulting from the speed of pressure changes in the discharge line of the controlled-capacity pump.

In accordance with these and other objects the essence of the present invention lies in providing a servomechanism for controlling the pump capacity, which includes an adjustable throttle of the nozzle-gate type which has two operating slots and communicates through two fixed throttles with a duct of a source of supply, an input signal converter whose movable element is connected to the gate of the nozzle-gate throttle, a four-slot, five-line distributor whose control spaces communicate through two fixed throttles with the duct of a source of supply and with two operating slots of the adjustable throttle, and whose operating spaces communicate with corresponding spaces of the hydraulic cylinder, the latter being connected by mechanical position feedback, to the element for controlling the pump capacity and to the gate, the feedback being constituted by a bar which is connected to the movable element of the hydraulic cylinder and which has a slanted surface interacting with a spring-loaded pusher, whose spring actuates the gate, so that, according to the invention, the servomechanism incorporates a device ensuring a linear dependence of the speed of hydraulic cylinder movement on the displacement of the gate away from the neutral position and acting on the slide valve of the four-slot, five-line distributor, and a mechanism for limiting the power of the controlled-capacity pump, that mechanism being linked mechanically with the hydraulic cylinder and the throttle gate, and hydraulically with the discharge line of the controlled pump.

This layout of the servomechanism ensures automatic control of a machine, e.g., an excavator, according to a constant power law, has a high operating speed, and eliminates the dependence of the speed of movement of the actuating hydraulic cylinder on the load.

Automatic control of the machine, according to the constant power law, is achieved because the power-limiting mechanism sums up the signals of the pump capacity and pressure in its discharge line, i.e., the servomechanism receives information about the consumed power.

As the load on the working element of the machine rises and, consequently, pressure in the pump discharge line increases, the power-limiting mechanism acts on the gate of the adjustable throttle, thus providing a signal for reducing the pump capacity by the value sufficient to ensure the stability of the consumed power.

As the load on the operating element of the machine decreases and, consequently, pressure in the discharge line of the controlled pump drops, the servomechanism will raise the pump capacity thus ensuring again the stability of the consumed power at the maximum possible output of the machine.

In this case the device ensuring linear dependence of the hydraulic cylinder speed on the displacement of the gate away from the neutral position and acting on the distributor slide valve provides for the hydraulic feedback by the speed of the actuating hydraulic cylinder. The feedback makes up for the increase of the load on the actuating hydraulic cylinder and for the drop in the pressure difference in the distributor operating slot, which leads to a reduced rate of flow of the operating fluid through the slot. The reduced rate of flow diminishes the speed of movement of the actuating hydraulic cylinder.

The stability of the speed of hydraulic cylinder movement is ensured by increasing the area through the operating slot of the distributor, so that the speed of cylinder movement remains a linear proportion of the displacement of the gate, and does not depend on the load.

The provision of the hydraulic feedback by the speed of the actuating hydraulic cylinder makes it possible to dispense with the springs in the control chambers of the distributor, since there is not need for a strict proportional movement of the distributor slide valve with respect to the gate.

This reduces the requirements for the manufacturing accuracy of the distributor elements, and simplifies the technology of their production.

The movement of the gate does not require a rise of pressure in the control chambers, which has previously been necessary for compressing the springs. Hence, the forces of the fluid jets applied to the gate diminish, while the operating speed of the servomechanism increases.

It is feasible for the power-limiting mechanism of the pump to include a bar formed with a curvilinear surface which ensures automatic control of pump capacity in accordance with a preset law, one end of the bar resting on a spring located in the casing, and the other end of the bar interacting with a plunger located in the casing and transmitting the force of the fluid pressure in the discharge line of the pump, a spring-loaded pusher interacting with the curvilinear surface of the bar and having mounted thereon a pivoted two-arm lever, a clearance being formed between the lever and the gate, the lever interacting with the gate by one arm thereof, while its second arm rests on the spring-loaded pusher of the mechanical position feedback of the hydraulic cylinder.

The introduction of a spring-loaded pusher with a pivoted two-arm lever provides a simple solution to the problem of summing up the signals of the pump capacity and pressure in its discharge line.

The summing up of the signals is confined to adding up two movements, viz., a rectilinear movement of the spring-loaded pusher, which is proportional to the capacity of the controlled pump, and turning of the two-arm lever, which is proportional to the changes of pressure in the discharge line of the controlled pump.

As long as the power consumed by the pump is smaller than the setting of the power-limiting mechanism, there remains a clearance between the arm of the two-arm lever interacting with the gate, and the gate. As the pump power rises, this clearance is taken up by the combined movement of the spring-loaded pusher and the two-arm lever, so that the lever starts interacting with the gate. This limits the power of the controlled pump, e.g., by the law of constant power, which limit is set by the curvilinear surface of the bar. Such a layout of the power-limiting mechanism wherein the power-limiting law is ensured by a curvilinear surface, provides for a better observance of the preset law than the straight sections of the characteristics of several springs approximating a hyperbola, as it occurs in the above-discussed mechanisms.

The spring-loaded pusher is an element of the mechanical position feedback of the hydraulic cylinder and, simultaneously, an element of the power-limiting mechanism. This simplifiers the design of the servomechanism and reduces its dimensions.

Each end of the bar formed with a curvilinear surface should be placed into a chamber, whose space communicates with the space of the nozzle.

This will ensure hydraulic feedback by means of the speed of pressure changes in the discharge line of the controlled pump, thereby protecting the pump and the entire hydraulic drive against a sharp pressure rise.

It then becomes possible to dispense with an additional bar to be used specially for the hydraulic feedback by means of the speed of pressure rise, and to use the bar already formed with a curvilinear surface, which simplifies the design of the servomechanism and reduces its size.

It is good practice for the power-limiting mechanism of the controlled pump to be provided with adjusting screws, one screw being installed on the arm of the two-arm lever interacting with the gate, the other screw being installed in the casing and interacting with the plunger, and the third screw being installed in the casing and interacting with the spring which supports the bar formed with the curvilinear surface.

Such an arrangement makes it possible to easily set the servomechanism for actuating the power-limiting mechanism at a certain pressure, which ensures the maximum permissible input power of the drive motor at a maximum capacity of the controlled pump.

It is feasible for the device ensuring linear dependence of the hydraulic cylinder speed on the displacement of the gate away from the neutral position, and acting on the slide valve of the four-slot, five-line distributor to be formed with two chambers whose spaces communicate with the corresponding control space of the distributor, each chamber receiving the end of the bar formed with a curvilinear surface.

This device provides for the feedback by the speed of the actuating hydraulic cylinder.

The provision of the feedback by the speed of displacement makes it possible to have the distributor having the slide valve without any springs disposed in the control spaces, the absence of the springs reducing the pressure difference on the slide-valve faces, increasing the operating speed of the servomechanism, and receiving the requirements for the manufacturing accuracy of the distributor parts, and to utilize positive closing of the distributor operating ports, as well as the make ports of a round shape.

Other objects and advantages of the present invention will become apparent from the following example of its embodiment, and from the accompanying drawings, in which.

Figure 1:
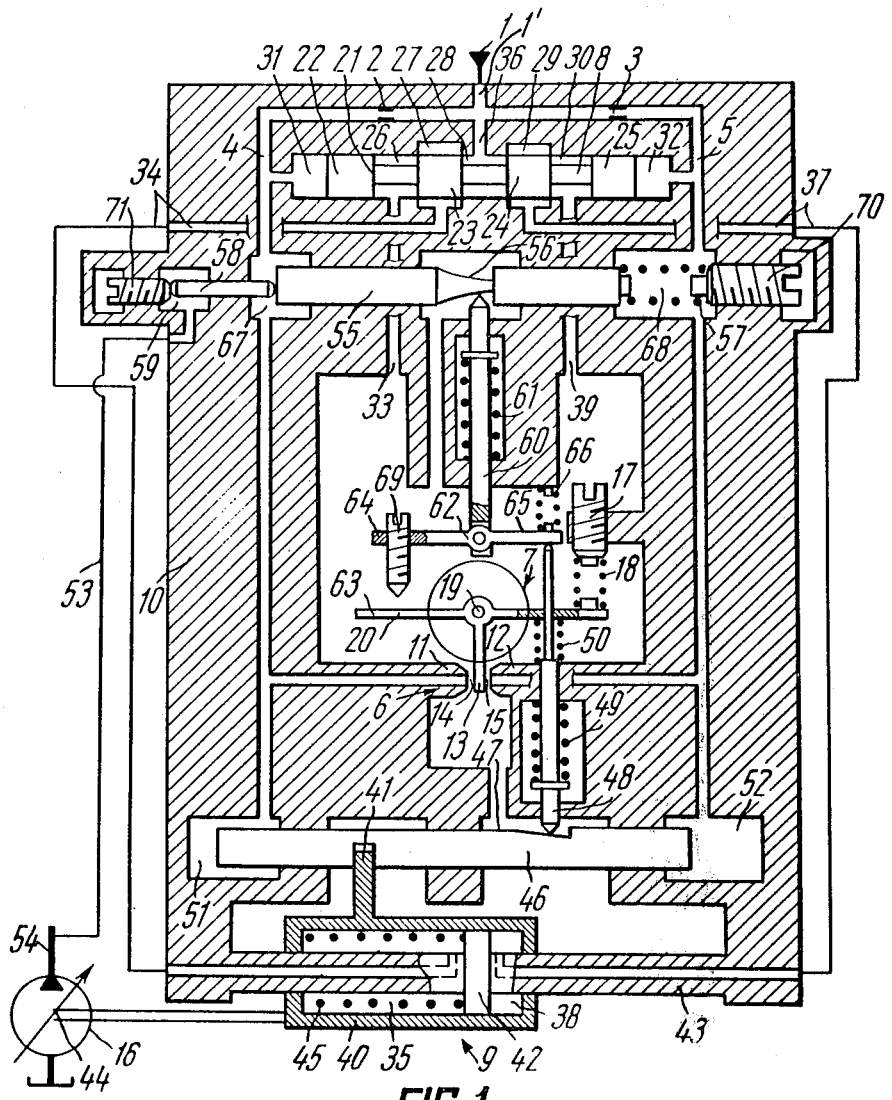
FIG. 1 is a schematic view of the servomechanism for controlling the pump capacity, according to the invention.

The servomechanism comprises a source of supply 1 feeding a duct 1; the latter communicates through two fixed throttles 2 and 3, and hydraulic lines 4 and 5 with an adjustable throttle 6 of the nozzle-gate type, an input signal converter 7, a four-slot five-line distributor 8, and an actuating hydraulic cylinder 9. All the above-mentioned elements of the servomechanism except the supply source 1, are accommodated in the servomechanism casing 10.

The adjustable nozzle-gate throttle 6 has two nozzles 11 and 12 and a gate 13 arranged between the nozzles 11 and 12 so as to form operating slots 14 and 15 of the throttle 6 between the side faces of the gate 13, and the nozzles 11 and 12.

At a zero capacity of the controlled pump 16 the effective cross-sectioned areas of the slots 14 and 15 correspond approximately to the center position of the gate 13. The gate 13 is set to the center position by a screw 17 which is located in the casing 10, and acts on the gate 13 via a spring 18.

The movable element of the input signal converter 7, e.g., shaft 19, is connected to the gate 13 of the throttle 6, the gate being rigidly mounted on the shaft 19. The gate 13 is made integral with a two-arm lever 20, and is capable of turning.

When the gate 13 turns, say, clockwise, the effective cross-sectional area of the operating slot 15 increases, and that of the slot 14 decreases.

The four-slot, five-line distributor 8 is made in the form of a slide valve 21 with four bands 22, 23, 24, 25, which, together with the inner surface of the casing 10, form operating spaces 26, 27, 28, 29, 30 and control spaces 31 and 32.

The control space 31 communicates through the fixed throttle 2 and the hydraulic line 4 with the duct 1′ of the source of supply 1, and with the operating slot 14 of the adjustable throttle 6. The control space 32 communicates via the hydraulic line 5 and the fixed throttle 3 with the duct 1′ of the source of supply 1 and the operating slot 15 of the adjustable throttle 6.

The operating space 26 communicates through a hydraulic line 33 with the return line; the operating space 27 communicates through a hydraulic line 34 with the space 35 of the hydraulic cylinder 9, the operating space 28 communicates through a hydraulic line 36 with the duct 1′ of source of supply 1, the operating space 29 communicates through a hydraulic line 37 with the space 38 of the hydraulic cylinder 9, and the operating space 30 communicates through a hydraulic line 39 with the return line.

The actuating hydraulic cylinder 9 comprises a movable element, e.g., casing 40 on which there is mounted a pin 41 and a fixed element, e.g., a piston 42 with rod 43. The movable casing 40 of the hydraulic cylinder 9 is linked kinematically with the element 44, which latter controls the capacity of the pump 16.

The movable casing 40 accommodates a spring 45 which returns the hydraulic cylinder 9 to the position of zero capacity of the controlled pump 16. One end of the spring 45 rests on the piston 42 and its other end on the inner face surface of the casing 40.

The actuating hydraulic cylinder 9 is connected via a the mechanical position feedback to the gate 13. The mechanical feedback includes a bar 46 with a slanted surface 47 interacting with a spring-loaded pusher 48, whose spring 49 presses the pusher against the slanted surface 47, whereas the spring 50 acts on the gate 13. The bar 46 has a slot receiving a pin 41. This insures a linkage between the bar 46 and the movable casing 40 of the hydraulic cylinder 9.

The servomechanism is provided with a device which ensures the linear dependence of the speed of movement of the casing 40 of the actuating hydraulic cylinder 9 on the displacement of the gate 13 away a neutral position corresponding to zero capacity of the pump, and which acts on the slide valve 21 of the distributor 8. This device is formed with two chambers 51 and 52. The chamber 51 communicates via the hydraulic line 4 with the control space 31 of the distributor 8, while the chamber 52 communicates via the hydraulic line 5 with the control space 32 of the distributor 8. One end of the bar 46 is received in the chamber 51 and its other end in the chamber 52. This device ensures hydraulic feedback by the speed of movement of the actuating hydraulic cylinder 9.

The servomechanism additionally incorporates a mechanism for limiting the power of the controlled pump 16. This mechanism is linked mechanically with the hydraulic cylinder 9 and the gate 13 of the throttle 6, and hydraulically, via the hydraulic line 53, with the dishcarge line 54 of the controlled pump 16.

The power-limiting mechanism includes a bar 55 with a curvilinear surface 56. The latter ensures automatic capacity control of the pump 16 according to a preset law, for example, the law of constant power.

One end of the bar 55 rests on a spring 57 received in the casing 10, while its other end interacts with the end of a plunger 58 received in the casing 10, the other end of the plunger entering into the chamber 59, which latter communicates via the line 53 with the discharge line 54 of the pump 16.

The power-limiting mechanism additionally includes a spring-loaded pusher 6 which interacts with the curvilinear surface 56 of the bar 55. This interaction is effected by the spring 61. On the pusher 60 there is pivoted is a two-arm lever 62 which is installed with a clearance relative to the arm 63 of the two-arm lever 20 of the gate 13.

The arm 64 of the lever 62 interacts with the gate 13, while the arm 65 rests with the aid of the spring 66 on the spring-loaded pusher 48 providing mechanical feedback of the position of the hydraulic cylinder 9.

One end of the bar 48 is located in the chamber 67, and its other end in the chamber 68. The chamber 59 communictes via the hydraulic line 4 with the space of the nozzle 11, while the chamber 68 communcates via the hydraulic line 5 with the space of the nozzle 12. This ensures hydraulic feedback by means speed of pressure changes in the discharge line 54 of the controlled pump 16. The hydraulic feedback by means of the speed of pressure changes in the discharge line of the controlled pump 16 protects the latter against a sharp pressure rise.

The power-limiting mechanism is provided with adjusting screws 69, 70, 71.

The screw 69 is installed on the arm 64 of the two-arm 64 of the two-arm level 62 interacting with the gate 13. The screw 70 is installed in the casing 10, and interacts with the spring 57 which supports the bar 55. The screw 71 is installed in the casing 10 and interacts with the plunger 58. The provision of the adjusting screws 69, 70 and 71 allows easy setting of the servomechanism, so that the power-limiting mechanism starts functioning at a certain pressure, which at a maximum capacity of the controlled pump 16 ensures the maximum permissible power input of the drive motor (not shown in the drawing).

The servomechanism for pump capacity control operates as follows:

When it becomes necessary to increase the capacity of the controlled pump 16, the operator sends a signal, e.g., and electric one, from the control panel to the electromagnetic input signal converter 7. The latter converts the electric input signal into a proportional mechanical torque, which turns the shaft 19 and, together with the latter, the gate 13 of the adjustable nozzle-gate throttle 6, for example, in a clockwise direction. This increases the effective cross-sectional area of the operating slot 15 of the adjustable throttle 6, and reduces the effective cross-sectional area of the operating slot 14; correspondingly, the hydraulic resistance of the slot 15 diminishes, and that of the slot 14 increases. This reduces the pressure of the operating fluid in the line 5, and the control space 32 of the distributor 8, coupled with a simultaneous rise of fluid pressure in the line 4 and the distributor control space 31.

The pressure difference in the control spaces 31 and 32 disturbs the equilibrium of the slide valve 21 of the distributor 8, and the slide valve 21 moves to the right.

The slide valve 21 will start moving at a small pressure difference in the control spaces 31 and 32 of the distributor 8, the difference being required only for starting it from rest.

After the slide valve 21 has begun moving, the pressure differnece will diminish, because the coefficient of friction of the moving slide valve 21 is less than the coefficient of its static friction.

A small pressure difference in the control spaces 31 and 32 of the distributor 8 and, consequently, in the operating slots 14 and 15 of theadjustable throttle 6, results in a small force being applied by the jets of fluid to the gate 13, which in turn raises the operating speed of the servomechanism.

After the slide valve 21 has started from rest, any further movement thereof will be proportional to the rate of flow of the fluid entering the control space 31, and leaving the control space 32.

As the slide valve 21 of the distributor 8 moves to the right, the operating space 26, of the distributor 8 is made to communicate with its operating space 27 and the operating space 28 is made to communicate with the working space 29. The working fluid is directed from the supply source 1 via the hydraulic line 36, the operating spaces 28, and 29 of the distributor 8 and the hydraulic line 37 into the space 38 of the actuating hydraulic cylinder 9. From the other space 35 of the hydraulic cylinder 9 the operating fluid flows through the hydraulic line 34, the operating spaces 27 and 26 of the distributor 8, and the hydraulic line 33 to the return line.

The movable casing 40 of the hydraulic cylinder 9 moves to the right and shifts the element 44, via a kinematic linkage, for controlling the capacity of the pump 16, thus increasing its operating volume and, consequently, its capacity.

The movement of the casing 40 of the hydraulic cylinder 9 is accompanied by the movement of the bar 46 formed with the slanted surface 47, the bar 46 being moved by the pin 41 secured to the casing 40.

The slanted surface 47 interacts with the spring-loaded pusher 48. Rising, the spring-loaded pusher 48 compresses the spring 50, which rests on the lever 20 of the gate 13, thus creating a torque on the gate 13 and, consequently, on the shaft 19 of the converter 7; this torque turns the gate 13 counter-clockwise. Thus, the mechanical feedback operating by the position of the actuating hydraulic cylinder 9 acts on the gate 13.

As soon as the torque applied to the gate 13 by the spring-loaded pusher which is an element of the mechanicl position feedback of the actuating hydraulic cylinder 9, becomes equal to the torque applied by the input signal of the converter 7, the gate 13 will turn to the initial center position, and the effective cross-sectional of the slots 14 and 15 of the adjustable throttle 6 will also become equal. The pressures in the control spaces 31 and 32 ofthe distributor 8 will also be equalized.

The feedback by means of the speed of movement of the actuating hydraulic cylinder 9 will begin functioning from the moment the cylinder 9 starts moving.

Moving to the left, the bar 46 forces the operating fluid from the chamber 52 into the hydraulic line 5, thus making up for the increased discharge of the fluid from the nozzle 12 due to a reduced resistance of the operating slot 15.

On the other hand, the bar 46 vacates a part of the volume in the chamber 51, which received the operating fluid from the hydraulic line 4, thus making up for the decreased discharge of the fluid from the nozzle 11 due to an increased resistance of the operating slot 14.

When the fluid discharge is completely made up, the slide valve 21 will stop, and the movable casing 40 of the hydraulic cylinder 9 will move at a speed which is proportional to the displacement of the gate 13 from the neutral position. At a different displacement of the gate 13, the cylinder 9 will start moving at a different speed, which is proportional to the gate displacement. This will ensure the linear dependence of the speed of the hydraulic cylinder 9 on the displacement of the gate 13.

Thus the speed of the hydraulic cylinder 9 depends on the displacement of the gate 13. This dependance shows itself through the ratio of discharges through the operating slots 14 and 15, and through the displacement of the bar 46 of the hydraulic feedback by means of the speed of the hydraulic; cylinder 9. The speed of the hydraulic cylinder does not depend on the configuration of the operating spaces 26, 27, 28, and 30 which simplifies the manufacture of the distributor 8 and provides for positive closing of the operating spaces 27 and 29 of the distributor 8.

The speed of the hydraulic cylinder 9 does not depend on its loading. As the hydraulic cylinder load increases, the pressure difference between the operating spaces 28 and 29 will diminish. This diminished difference is made up by an increase in the area of the slot between the spaces 28 and 29 due to an increased travel of the slide valve 21 to the right, so that the rate of flow of the fluid entering the hydraulic cylinder 9 will remain constant.

The fact that the speed of movement of the hydraulic cylinder 9 is independent of its loading constitutes another advantage of the servomechanism, according to the present invention.

Should it become necessary to reduce the capacity of the controlled pump 16, the operator sends a signal of opposite sign from the control panel, and the whole process is reversed.

As long as the pump 16 operates under the conditions when the power input from the drive motor is less than the maximum permissible limit, the power-limiting mechanism plays no part in the control of the pump 16. A clearance is formed between the lever 62 and the gate 13, and the power-limiting mechanism does not act on the gate 13.

When the load, and consequently, the pressure in the discharge line 54 of the controlled pump 16, rises to the value at which the pump operating at a given capacity would require a power higher than the permissible maximum, the power-limiting mechanism reduces the pump capacity to a level at which the input power is equal to the maximum permissible value at a given load, and consequently, pressure. Thus, if the operator sets the controls of a machine operated, e.g., an excavator, on the control panel to the maximum output, the power-limiting mechanism of the controlled pump will ensure automatic control of the machine in accordance with the law of constant power.

The power-limiting mechanism functions by summing up the capacity signal of the pump 16 and the pressure signal in its discharge line 54, thus receiving information about the consumed power. The capacity signal is received by the power-limiting mechanism from the controlled pump through the mechanical linkage with the hydraulic cylinder 9.

The arm 65 of the lever 20 rests with the aid of the spring 66 on the spring-loaded pusher 48 of the mechanical feedback by means of the position of the hydraulic cylinder 9. The use of the pusher 48, both as an element of the mechanical position feedback of the hydraulic cylinder 9, and as an element of the power-limiting mechanism of the controlled pump 16, simplifies the design of the servomechanism, and reduces its dimensions.

While controlling the capacity of the pump 16, the spring-loaded pusher 48 interacts with the slanted surface 47 of the bar 46 and moves up or down, turning the lever 62 through an angle which is proportional to the capacity of the pump 16.

The pressure signal in the discharge line 54 of the controlled pump 16 is received by the power-limiting mechanism through the hydraulic feedback. The increased pressure in the discharge line 54 increases pressure in the chamber 59, which communicates via theline 53 of the discharge line 54 of the controlled pump. The plunger 58 moves the bar 55 to the right, thus compressing the spring 57. The curvilinear surface 56 of the bar 55, shaped to a hyperbola corresponding to the law of constant power, acts on the spring-loaded pusher 60, moving it down through a distance which is proportional to the increase in pressure in the discharge line 54 of the controlled pump 16. The lever 62 pivoted on to the pusher 60 moves down together with the pusher.

Thus, the position of the arm 63 of the lever 62 depends on two motions, viz., a vertical motion together with the pusher 60, which is proportional to the pressure in the discharge line 64 of the controlled pump 16 and a turning motion caused by the pusher 48, proportional to the capacity of the controlled pump 16, which means that this position of the arm 62 is determined by the power of the controlled pump 16. When pressure is increased so that the input power at the given capacity can surpass the permissible limit, the lever arm 64 will take up the clearance, and start acting on the gate 13, creating a torque which turns the gate 13 counterclockwise. This will ensure the required reduction in the capacity of the pump 16.

When the servomechanism is set for automatic duty, and when the load varies within the limits in which the operation of the pump 16 is governed by its capacity, the gate 13 will be subjected to two moments; a constant moment created by the maximum input signal of the input signal converter 7, and a variable moment created by the action of the arm 64 of the lever 20 of the power-limiting mechanism, and by the force of the spring 50 of the position feedback. The power-limiting mechanism tends to turn the variable moment into a constant moment which is equal to the constant moment of the control signal, by reducing or increasing the capacity of the pump 16 and, as a consequence, by reducing or increasing the force of the spring 50 applied to the gate 13, and of the pusher 48 applied to the arm 65 of the lever 62. In this case the servomechanism will ensure automatic control of the pump 16 in accordance with the law of constant power.

Being an element of the power-limiting mechanism, the bar 55 is used simultaneously as an element of feedback by the ratio of pressure rise in the discharge line 54 of the controlled pump 16.

As the pressure rises in the discharge line 54 of the pump 16, the plunger 58 acted upon by the pressure of the operating fluid in the chamber 59, which latter communicates with the discharge line 54 through the line 53, will start moving to the right at a speed proportional to the rate of pressure rise. Bearing against the end of the bar 55, the plunger will move it to the right.

The bar will force the operating fluid from the chamber 68 into the hydraulic line 5, and vacate the volume in the chamber 67 for the admission of the operating fluid from the hydraulic line 4.

The operating fluid flows from the hydraulic line 5 into the control space 32 of the distributor 8, moving it to the left and thus reducing the capacity of the pump 16. In this manner the feedback by the rate of pressure rise in the discharge line 54 of the pump 16 safeguards the latter against a sharp increase of pressure.

Screws 69, 70 and 71 are used to set the power-limiting mechanism so that it will start functioning at a certain pressure, which ensures the consumption of the maximum permissible power of the drive motor at the maximum capacity of the controlled pump 16. The screw 69 allows the plunger 58 and bar 55 to be moved axially, thus setting the point of the curvilinear surface at which the surface will start interacting with the spring-loaded pusher 48.

Screw 70 allows the mechanism to be set for the value of the initial pressure, at which it will start functioning due to the precompression of the spring 57.

A screw 71 is provided for adjusting the clearance between the arm 64 of the lever 62 and its arm 63.

Figure 2:
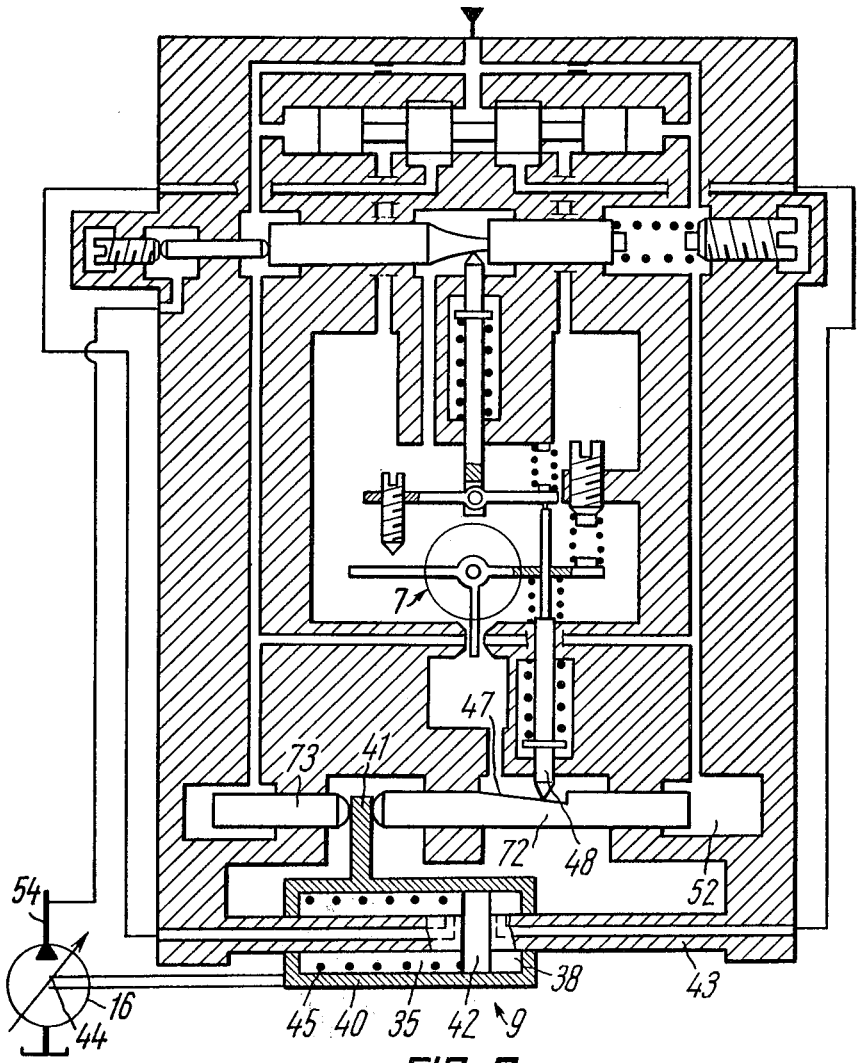
FIG. 2 shows another version of the servomechanism according to the invention.

The bar 42 can be replaced by two bars 72 and 73 (FIG. 2) which will allow elimination of the clearance between the bar 16 (FIG. 1)and the pin 41.

The ends of the bars 72 and 73 (FIG. 2) facing the pin 41 have spherical butt surfaces, which relieves the springs of radial forces and reduces friction during their movement.

We claim:

1. A servomechanism for pump capacity control comprising a casing; an adjustable throttle of the nozzle-gate type received in said casing, said throttle having a gate and two nozzles, said nozzles having end faces, operating slots of said throttle being formed between said gate and the end faces of said nozzles; two fixed throttles received in said casing; a source of supply feeding a duct, said duct communicating through said two fixed throttles with said adjustable throttle; an input signal converter received in said casing; a movable element of said input signal converter linked with said gate; a four-slot, five-line distributor having a slide valve and being formed with a plurality of control and operating spaces, installed in said casing; said control spaces communicating through said two fixed throttles with said duct of said source of supply and with said two operating slots of said adjustable throttle; an element for controlling the capacity of said pump, said pump having a discharge line; an actuating hydraulic cylinder being formed with a plurality of spaces, having a movable element and being located in said casing, connected to the pump capacity control element and linked by mechanical position feedback with said gate the spaces of said actuating hydraulic cylinder communicating with the corresponding operating spaces of said four-slot, five-line distributor; a bar located in said casing, formed with a slanted surface and connected to said movable element of said actuating hydraulic cylinder; a spring-loaded pusher installed in said casing and interacting with said slanted surface of the bar; the spring of said pusher being received in said casing and acting on said gate, said bar and said spring-loaded pusher constituting said mechanical position feedback of said hydraulic cylinder; a device located in said casing for ensuring a linear dependence of the speed of movement of said hydraulic cylinder on the displacement of said gate away from the neutral position and acting on said slide valve of the four-slot, five-line distributor; a mechanism for limiting the power of said pump, linked mechanically with said hydraulic cylinder and said gate, and hydraulically with said discharge line of said controlled-capacity pump.

2. A servomechanism according to claim 1 wherein said power-limiting mechanism of the controlled pump comprises a bar with a curvilinear surface ensuring automatic control of pump capacity according to a preset law; a spring received in said casing; a plunger located in said casing and transmitting fluid pressure in said discharge line of the controlled pump, one end of said bar resting on said spring, its other end interacting with said plunger, a spring-loaded pusher interacting with said curvilinear surface of the bar, a two-arm lever pivoted on said spring-loaded pusher, a clearance being formed between said spring-loaded pusher and said gate, one arm of said lever interacting with said gate, the other arm of said lever resting on said spring-loaded pusher of said mechanical position feedback of the hydraulic cylinder.

3. A servomechanism according to claim 2 wherein two chambers are formed in said casing and communicate with the spaces of said nozzles, each end of said bar formed with the curvilinear surface being located in said chamber.

4. A servomechanism according to claim 2 wherein said mechanism for limiting pump power further comprises adjusting screws, one of said screws being installed on said arm of the two-arm lever interacting with said gate, the other arm being installed in said casing and interacting with the plunger, the third arm being installed in said casing and interacting with said spring supporting said bar formed with the curvilinear surface.

5. A servomechanism according to claim 3 wherein said mechanism for limiting pump power comprises adjusting screws, one of said screws being installed on said arm of the two-arm lever interacting with said gate, the other arm being installed in said casing and interacting with the plunger, the third arm being installed in said casing and interacting with said spring supporting said bar formed with the curvilinear surface.

6. A servomechanism according to claim 1 wherein said device ensuring the linear dependence of the speed of hydraulic cylinder movement on the displacement of the gate away from the neutral position and acting on the slide valve of the four-slot, five-line distributor is formed with two chambers located in said casing, said chambers communicating with the corresponding control spaces of said distributor, each of said chambers receiving one end of said bar formed with the slanted surface.

7. A servomechanism according to claim 2 wherein said device ensuring the linear dependence of the speed of hydraulic cylinder movement on the displacement of the gate away from the netural position and acting on the slide valve of the four-slot, five-line distributor is formed with two chambers located in said casing, said chambers communicating with the corresponding control spaces of said distributor, each of said chambers receiving one end of said bar formed with the slanted surface.

8. A servomechanism according to claim 3 wherein said device ensuring the linear dependence of the speed of hydraulic cylinder movement on the displacement of the gate away from the netural position and acting on the slide valve of the four-slot, five-line distributor is formed with two chambers located in said casing, said chambers communicating with the corresponding control spaces of said distributor, each of said chambers receiving one end of said bar formed with the slanted surface.

9. A servomechanism according to claim 4 wherein said device ensuring the linear dependence of the speed of hydraulic cylinder movement on the displacment of the gate away from the neutral position and acting on the slide valve of the four-slot five-line distributor is formed wth two chambers located in said casing, said chambers communicating with the corresponding control spaces of said distributor, each of said chambers receiving one end of said bar formed with the slanted surface.

* * * * *